United States Patent [19]

Sewell et al.

[11] Patent Number: 4,921,583

[45] Date of Patent: May 1, 1990

[54] BELT PLATING METHOD AND APPARATUS

[75] Inventors: Beverley Sewell, Alton; David J. Hill, Lightwater; Edgar C. Martin, Kingston, all of United Kingdom

[73] Assignee: Twickenham Plating & Enamelling Co., Ltd., Twickenham

[21] Appl. No.: 303,616

[22] Filed: Jan. 27, 1989

[30] Foreign Application Priority Data

Feb. 11, 1988 [GB] United Kingdom ..... 8803186

[51] Int. Cl.[5] ..... C25D 5/02; C25D 5/08; C25D 17/00

[52] U.S. Cl. ..... 204/15; 204/206; 204/224 R; 204/279

[58] Field of Search ..... 204/15, 224 R, 206, 204/279, 194

[56] References Cited

U.S. PATENT DOCUMENTS

| | | | |
|---|---|---|---|
| 3,723,283 | 3/1973 | Johnson et al. | 204/206 |
| 3,746,630 | 7/1973 | Kosowsky et al. | 204/206 |
| 4,132,617 | 6/1979 | Noz | 204/206 |
| 4,376,017 | 3/1983 | Urion | 204/15 |
| 4,414,075 | 11/1983 | Cockeram | 204/224 R |
| 4,431,500 | 2/1984 | Messing et al. | 204/206 |
| 4,493,757 | 1/1985 | Piepers | 204/224 R X |
| 4,582,583 | 4/1986 | Laverty et al. | 204/206 |
| 4,770,754 | 9/1988 | Meuidijk et al. | 204/224 R |

FOREIGN PATENT DOCUMENTS

| | | |
|---|---|---|
| 1458922 | 12/1976 | United Kingdom . |
| 1477024 | 6/1977 | United Kingdom . |
| 8103187 | 11/1981 | World Int. Prop. O. . |

OTHER PUBLICATIONS

Donaldson, John G., "Continuous Strip Plating Electronic Components–Part I", Jan. 1987, pp. 29–31, Metal Finishing.

*Primary Examiner*—Donald R. Valentine
*Attorney, Agent, or Firm*—Shlesinger & Myers

[57] ABSTRACT

A thin plastic elongate mask is disclosed for use in continuously electroplating an elongate substrate. Apparatus is disclosed wherein the mask is mated with the substrate, is passed through an electroplating zone, supported by support belts, such that only those areas of elongate substrate covered by plating cavities in the mask are plated. The mask may be located on the substrate by means of corresponding location features positioned on the elongate substrate and the mask. A method of continuously electroplating an elongate substrate using a thin plastic elongate mask is further disclosed.

24 Claims, 3 Drawing Sheets

BELT PLATING METHOD AND APPARATUS

Figure 1:
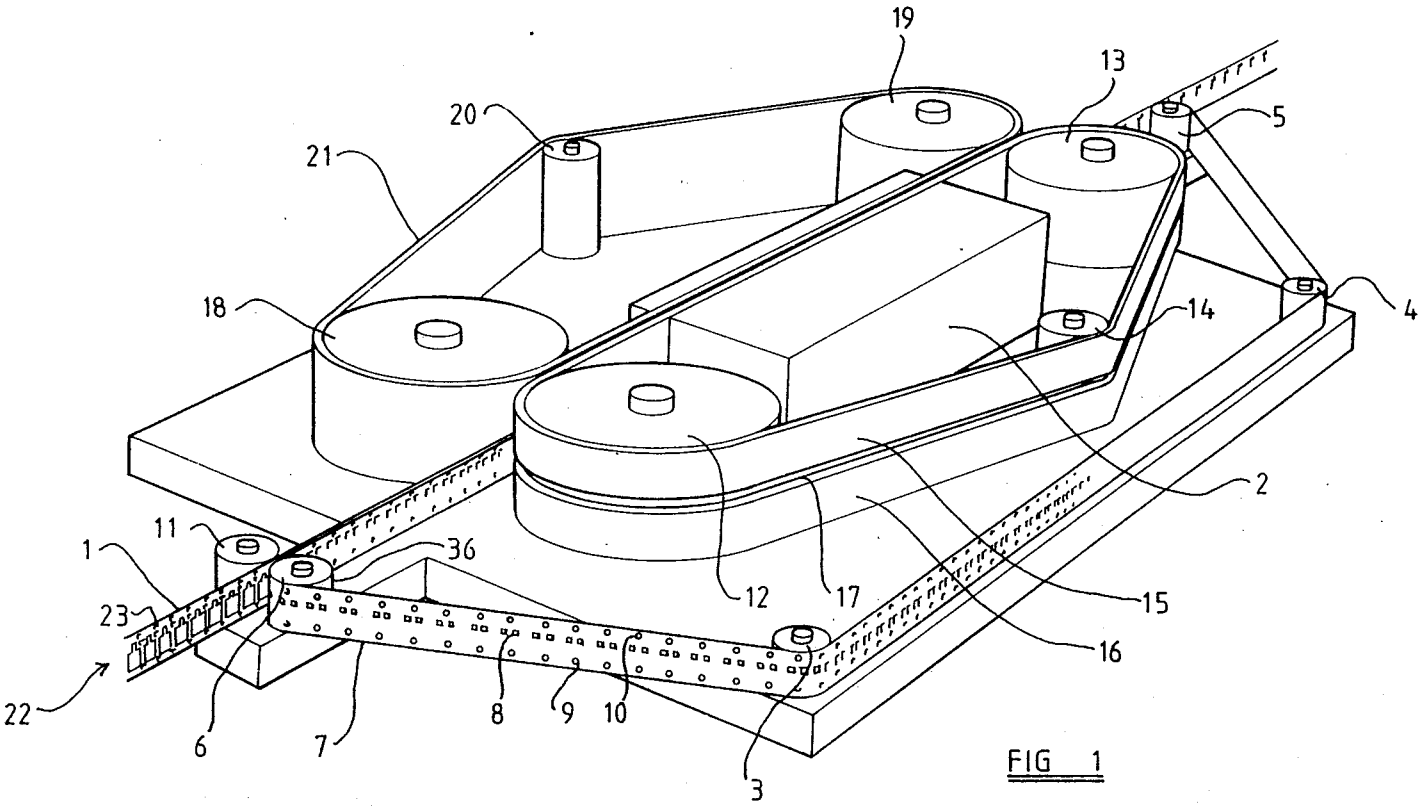

The present invention relates to a plating mask for use in electroplating a substrate and more particularly to a thin plastic elongate mask for use in continuously electroplating an elongate substrate, and apparatus and methods for use therewith.

A great deal of the work carried out by the electroplating industry is carried out on components for electronic and electrical goods. Recently pressure has increased for small areas of such components to be selectively plated, both to save the cost of expensive precious metals and due to increasing trends towards miniaturisation of goods, and thus the components therein.

The present inventors have realised that this necessity for plating smaller areas of substrates has given rise to a problem with the tools currently used by the electroplating industry. At present the electroplating industry plates components, or strips of components, by means of a "step and repeat" system, using plating masks, to protect those parts of the substrate which are not to be plated, of about 6.25 mm thick. Such a mask is placed over the components to be plated, the component and mask are placed adjacent a plating jet or other means of electroplating, the appropriate areas of the component exposed by the mask, are plated, and the mask and substrate are removed to allow a further mask and substrate to be inserted adjacent the plating jet or other plating means. This system works perfectly well for large areas to be plated but the inventors have realised when three major problems occur with the present system when applied to plating relatively small areas, such as spots, on component, and especially on strips of components, each having relatively small areas to be plated.

The first problem encountered with the present system when plating small areas is that the thickness of the electrodeposits produced on the plated areas tend to vary unacceptedly. The present inventors had discovered this phenomenon is due to the thickness of the mask, which thickness prevents even electroplating in two ways. Firstly the side of the mask around an aperture covering an area to be plated form a plating cavity around the area of substrate to be plated, which cavity is too narrow and too deep to allow even fine jets of electrolyte to fully enter the cavity, and thus high speed electrolyte flow at the exposed substrate surface is difficult to achieve. In practice this difficulty leads to a varying amount of agitation of electrolyte in each cavity formed by a single mask and thus the thickness of the electrodeposit on the substrate produced by each cavity varies proportionaly. Because the "spots" to be created by plating must have a minimum thickness, for a single mask having several mask cavities some spots are plated excessively thickly, in order to ensure that all plated spots defined by the mask achieve the minimum thickness of plating.

Secondly, the deep walls of the plating cavity shield the electric current field which is required for the electroplating. The inventors have discovered that less current (potential) can be applied around the edge of the surface of the substrate exposed by the prior art mask than at the center. This results in a "crescent" shaped thickness distribution over the spot to be plated, with the plating material being thickest at the center and thinest at the edge of the spot. Thus, to ensure minimum thickness over the required minimum area it is necessary to overplate the substrate, either by plating a larger area than is required or by plating at least some of the required area with a greater thickness of electrodeposit than is necessary, or a combination of both.

The inventors have concluded that these problems are caused by the thickness of masks presently used in the art and so by depth of the cavities formed by the masks.

The inventors have realised that a second problem with the present masking systems is the inflexibility of present static mask plates. In particular such a static mask plate, having a row of cavities, which mask plate is designed to mate with a substrate such as a strip of components or a bandolier of components, is inflexible, expect for any change in linear dimensions which may be due to thermal expansion. It is often found that such strip or bandolier substrates often do not comply with drawing tolerances, particularly with respect to pitch dimension, which pitch dimension is often affected by differences between stamping tools, wear of stamping tools, residual stresses in the raw materials, and subsequent heat treatment. As it should be clear, a small pitch difference may cause a mismatch of the cavities in the mask plate with the areas to be plated. The accumulative error produced by a series of such pitch errors across a strip, or bandolier, of components may often be larger than the dimension of the area to be plated, thus resulting in complete misplacement of the plating area on the components at one end of the strip because the plating cavities of the mask are disaligned with the substrate. At present the mask cavities are made considerably larger than the specified minimum plated spot size to overcome this deficiency, which results in gross overplating and a consequent waste of valuable plating metal.

Thirdly, the exact placing of the mask onto the substrate is often a difficult task and, as the area to be plated becomes smaller, accurate registration of the mask with the substrate has become more difficult.

Furthermore the present masks, being somewhat thick and unwieldly, are expensive and time consuming to produce and often the size of the mask and the consequent difficulty in producing mask cavities, prevents the possibility of the mask containing multiple rows of mask orifices or cavities.

It is an object of the present invention to overcome, or at least mitigate, the above disadvantages of the prior art.

According to a first aspect of the present invention there is provided a thin plastic elongate mask for use in continuously electroplating an elongate substrate.

It is preferable that the mask has a thickness of no greater than one millimeter and it is further preferable that the mask is no thinner than 0.0125 millimeters. Preferably the thickness of the mask is between 0.0125 and 0.5 mm and a particularly preferred thickness of the mask is 0.127 mm.

The mask is plastic, that is to say is deformable, is preferably resiliently deformable, and may be made of a plastics material such as polyester, polycarbonate, polyacetate, Kaptan, polyimide or epoxide. The mask may also be made of an elastic material, such as rubber, with suitable enforcement around the various apertures in the mask.

The mask comprises plating cavities to define the areas of substrate to be plated and the mask preferably further comprises location features such as dimples, molded inserts of plastic, stamped in metal studs, pins or rivets or recesses. It is most preferable that these location features are produced at the same time that the plating cavities are cut to ensure accurate placement and interrelation. As will be described later, these location features mate with corresponding features on the substrate, to position the mask correctly over the substrate.

It is further preferable that the mask further comprises pilot holes, corresponding to pilot holes in an elongate substrate to be plated, which pilot holes are designed to receive the spokes of a pin wheel so as to accurately mate the mask with the substrate.

According to a second aspect of the present invention there is provided apparatus for continuously electroplating an elongate substrate, the apparatus comprising an electroplating zone, at least one plastic elongate mask, mating means for releasably mating the mask with an elongate substrate and feeding means for feeding the mated mask and substrate through the electroplating zone so that, in use, only given areas of the substrate are plated.

Preferably the mask has those features which are preferred in the first embodiment of the invention. More preferably the mask is in the form of an endless belt or stript.

Preferably the mating means comprise complimentary location features, for example corresponding projections and recesses, positioned on the substrate and mask respectively. It is envisaged that the location features may further comprise corresponding pilot holes in both the substrate and mask, for engagement with the spokes of a pin wheel.

In one embodiment of this apparatus at least one support belt is provided to support the mated mask and substrate within the electroplating zone. Preferably the support belt is an endless belt, movable in the same direction and at the same speed as the mated mask and substrate in the electroplating zone. An embodiment is envisaged wherein two support belts are provided which belts, when supporting the mask and substrate, are located between the mask and an electroplating apparatus, one belt located above the area to be plated and one belt located below the area to be plated, both support belts extending longitudinally with respect to the mated mask and substrate. In such an embodiment there may be a further support belt located on the other side of the substrate from the mask, in the electroplating zone.

Alternatively, the electroplating zone may be adapted to plate the substrate from two sides. In such a case the apparatus is provided with two masks, the masks being adapted to engage an elongate substrate, one on either side of the substrate, in the electroplating zone and each mask may have associated with the masks two support belts, one belt located above the area to be plated and one belt located below the area to be plated, the belts extending longitudinally with respect to the substrate and mask.

The width of the gap created between two support belts on one side of a mask, one belt located above the area to be plated and one belt located below the area to be plated, may be adjustable so as to control the distribution of the thickness of the electrodeposit on a substrate. Preferably support belts used in this apparatus are three to ten millimeters thick and are most preferably made of reinforced rubber, such a chloroprene, silastomer or polyurethane.

Preferably the feeding means, for feeding the mask and an elongate substrate through the electroplating zone, comprises rollers and more preferably the feeding means further comprises a pin wheel, which pin wheel may also comprise the mating means. It is envisaged that the same or separate rollers may also serve to feed support belts through the electroplating zone.

The electroplating zone may comprise any electroplating apparatus, such as a jet plating apparatus, and it is preferable that the flow of electrolyte at the surface of a substrate is sufficiently high, for instance in excess of two meters per minute, to support high speed electrodeposition.

According to a third aspect of the present invention there is provided a method of continuously electroplating an elongate substrate, the method comprising mating an elongate substrate with a thin plastic elongate mask so that only given areas of the substrate are exposed by the mask, feeding the mated substrate and mask through an electroplating zone so that the given areas are electroplated, and releasing the plate and substrate from the mask.

It is preferred that the thin plastic elongate mask has the preferred features of the first aspect of the present invention. Preferably the elongate substrate and the mask are mated by means of location features such as those preferred in the second aspect of the present invention.

It is preferred that the mated substrate and mask be supported in contact with each other through the electroplating zone, or instance by support belts such as those described with reference to the second aspect of the invention. In such a case it is preferred that two support belts are used, one belt located above the area to be plated and one belt located below the area to be plated, in the electroplating zone, the support belts being positioned longitudinally with respect to the elongate substrate and mask. The gap between the two support belts may be adjustable so as to control the distribution of thickness of the electrodeposit on a substrate.

It is preferable that the mated mask and substrate may be fed through the electroplating zone by means such as those described with reference to the second aspect of the present invention.

It is further preferable that the electroplating zone comprises a jet plating apparatus and it is more preferable that the flow of electrolyte at the surface of the substrate is in excess of two meters per minute.

It is envisaged in all aspects of the present invention that the mask may be reusalbe, for instance as an endless band which, having been released from the substrate is fed to the opposite side of the electroplating zone and is mated with a portion of the elongate substrate which has not been plated.

Figure 2:
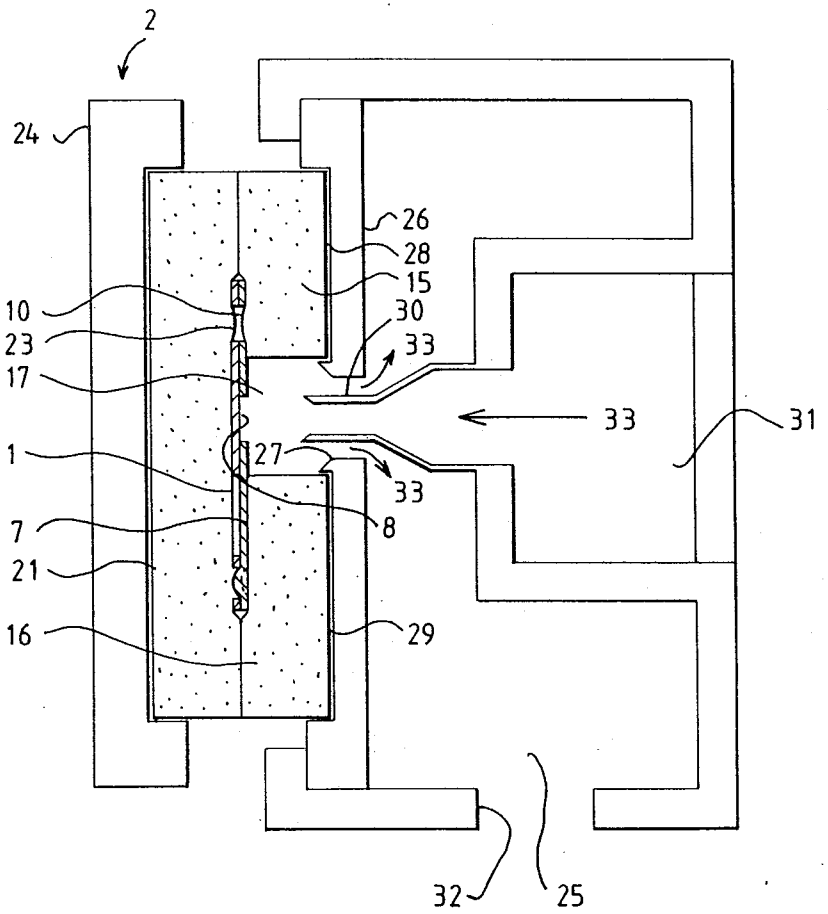
Figure 3:
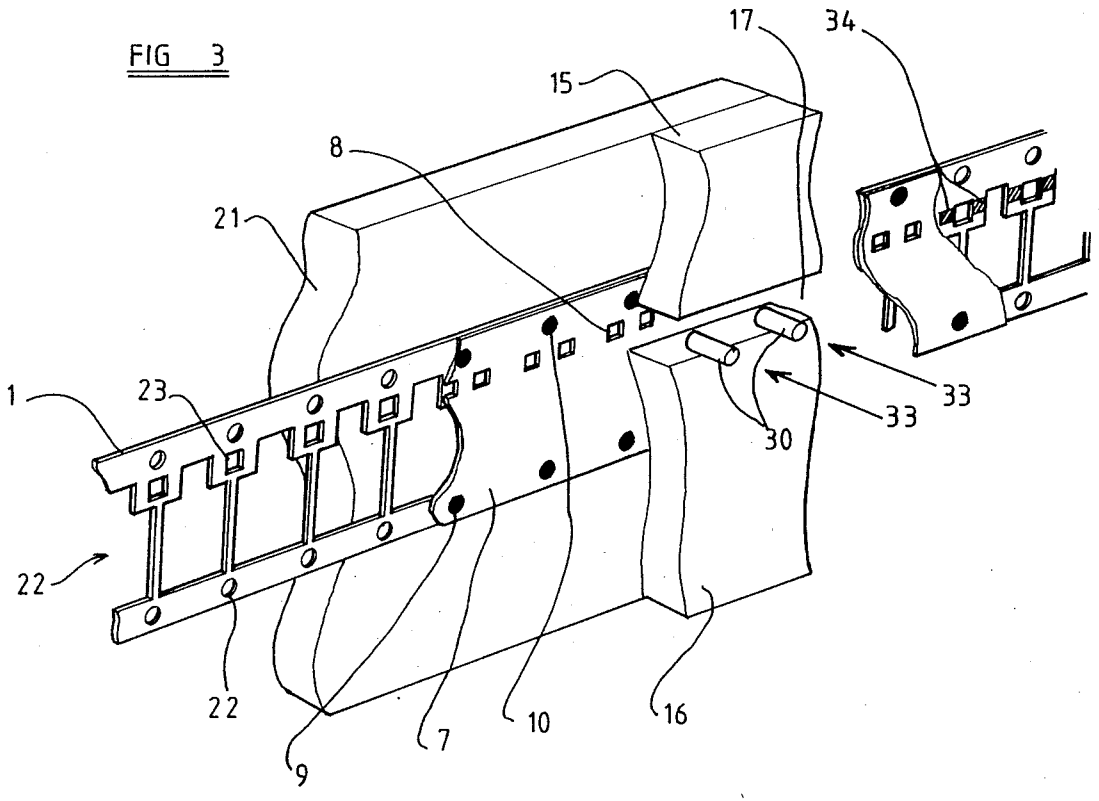

For better understanding of the present invention, and to show how the same may be put into effect, reference will now be made, by way of example only, to the accompanying drawings, in which:

FIG. 1 shows a perspective view from above and to one side of an apparatus according to the second aspect of the present invention, FIG. 2 shows transverse cross section of the electroplating zone of the apparatus of FIG. 1 taken along lines II—II and FIG. 3 shows a partial cross-section view of the mated mask and substrate of FIG. 1 within the electroplating zone.

FIG. 1 shows an apparatus according to the second aspect of the present invention. The apparatus is used for selectively electroplating a strip of components 1. The apparatus has an electroplating zone 2 within which is contained apparatus for jet plating the strip of components 1.

A thin plastic mask 7, 0.127 mm thick, is provided as an endless band wound around mask rollers 3, 4 and 5 and around a pin wheel 6. The pin wheel 6 and one of the mask rollers 5 are positioned either side of, and level with, the electroplating zone 2 and the remaining two mask rollers 3, 4 are positioned to the rear of the electroplating zone 2 between the front mask roller 5 and the pin wheel 6. The mask 7 is wound around the mask rollers 3, 4, 5 and the pin wheel 6 so that the mask 7 passes through the electroplating zone 2 and is then returned behind the electroplating zone 2. The mask rollers 3, 4, 5 and pin wheel 6 may be freely moveable or may be powered by a motor. In use the elongate substrate 1 passes the pin wheel 6 and the first roller 5, through the electroplating zone 2, so that the mask 7 is positioned between the substrate 1 and the pin wheel 6 and is positioned between the substrate 1 and the front mask roller 5.

The mask 7 is provided with a plurality of plating cavities 8 arranged in a repeating pattern along the length of the mask 7, and with location features 9, in the form of dimples, which location features 9 are also in a repeating pattern along the length of the mask 7. The position of adjacent locating features 9 and plating cavities 8 are correlated along the length of the mask 7. The mask further possesses pin holes 10, located along the top of the mask 7 at regular intervals, the pinholes 0 being designed to receive spokes 36 of the pin wheel 6 and each consecutive pin hole 10 is positioned longitudinally of the mask 7 so as to receive a consecutive spoke of the pin wheel 6.

On the other side from the pin wheel 6 is a clamping roller 11. This clamping roller 11 is designed to press together the mask 7 and the elongate substrate 1 as they pass between the clamping roller 11 and the pin wheel 6.

Positioned adjacent the electroplating zone 2 are two large support rollers 12 13, one large support roller 12, 13 placed either side of the electroplating zone 2 in the intended direction of movement of the substrate 1. Directly behind the electroplating zone 2 is a small support roller 14. Around these three support rollers 12, 13 14 are positioned two support belts 15, 16, one support belt 16 being positioned about the bottom of the support rollers 12, 13, 14 and the other of the supportive belts 15 being positioned around the top of the support rollers 12, 13, 14, there being a horizontal gap 17 between the two support belts 15, 16. The support belts 15, 16 are positioned around the outside of the support rollers 12, 13, 14 so that the belts pass through the electroplating zone 2 and then behind the electroplating zone 2. The apparatus comprising the support belts 15, 16 and the support rollers 12, 13, 14, is positioned within the endless belt formed by the mask 7. The gap 17 between the two support belts 15, 16 is positioned within the electroplating zone 2 at the same height as the plating cavities of the mask 7, within the electroplating zone 2 (see FIGS. 2 and 3).

Slightly to the front of the electroplating zone 2 are positioned two front support larger rollers 18, 19 each adjacent a respective large support roller 12, 13. A small front support roller 20 is positioned directly in front of the electroplating zone 2, further from the electroplating zone than the two large front support rollers 18, 19. Wound around these three front support rollers 18, 19, 20 is a front support belt 21. This front support belt 21 has the same width as the combined width of the two support belts 15, 16 and the gap therebetween 17. The front support belt 21 is wound round the three front support rollers 18, 19, 20 so that the front support belt 21 passes through the electroplating zone 2, on the other side of the mask 2 and substrate 1 from the two support belts 15, 16, and round the smaller front support roller 20 at the front of the electroplating zone 2 before returning to the electroplating zone 2. In this way the mask 7 and substrate 1 are sandwiched between the front support belt 21 and the two support belts 15, 16, within the electroplating zone 2, such that the substrate 1 is contacted by the front support belt 21 and the mask 7 is contacted by the two support belts 15, 16.

In use the substrate 1 is passed through the electroplating zone 2 along the direction shown by the arrow 22 in FIG. 1. The entrance and exit to the electroplating zone 2 are defined with respect to the direction of movement of the substrate 1. In this respect it should be seen that, especially if the front mask roller 5 is also a pin wheel, that this apparatus may be operated in either direction.

Before operation of the apparatus one end of the elongate substrate 1 is mated with the mask 7 and placed between the large support roller 12, and the large front support roller 18, adjacent the entrance of the electroplating zone 2. For the purposes of mating the elongate substrate 1 with the mask 7 the elongate substrate 1 has location apertures 22 which are spaced apart along the elongate substrate 1 by the same distance as the spacing apart of the location features 9 of the mask 7. Further, the location apertures 22 of the elongate substrate 1 are adapted to mate with the location features 9 of the mask 7. The elongate substrate 1 further has pin holes 23 spaced apart at regular intervals along the top of the elongate substrate 1, which pin holes 23 are adapted to receive a spoke 36 of the pin wheel 6, adjacent pin holes 23 being spaced apart so as to receive adjacent spokes 36 of the pin wheel 6. It should be noted that the position of the pin holes 23, the location apertures 22 and the areas to be plated of elongate substrate 1 are all correlated, and that the position of the plating cavities 8, the location features 9, and the pin holes 10 of the mask 7 are also all correlated and that the correlations of these features in the elongate substrate 1 and in the mask 7 are the same. Thus when a location feature 9 of the mask 7 is mated with a location aperture 22 of the substrate 1 the corresponding plating cavities 8 of the mask 7 will mate with the areas to be plated of the substrate 1 and the corresponding pin hole 10 of the mask 7 will mate with the corresponding pin hole 23 of the substrate 1.

It should be noted at this point that a first advantage of the thin elongate plastic mask is that, due to the plastic nature of the mask, the mask may be deformed to allow the location features 9 of the mask to correspond to location apertures 22 of the substrate and the pin holes 10 of the mask may be aligned with the pin holes 23 of the substrate 1 to allow for variations in pitch of the individual components of the elongate substrate 1.

In use the substrate is fed through the electroplating zone by opposing rotational movements of the large support roller 12, and large front support roller 18 adjacent the entrance of the electroplating zone 2, which large rollers 12, 18 grip the substrate 1 and the mask 7 which is mated therewith, and pass the substrate through the electroplating zone 2. The mask 7 maybe moved solely by this same means, that is to say by the clamping and consequent feeding by the two large rollers 12, 18 adjacent the entrance to the electroplating zone or, alternatively, one or more of the mask rollers 3, 4, 5 and the pin wheel 6 may also be individually powered by a motor, so that the mask roller(2) 3, 4, 5 and/or the pin wheel 6 move at the same speed as the two large rollers 12, 18. When the end of the elongate substrate 1 has been mated appropriately with the mask 7, the mated mask 7 and substrate 1 are fed into the electroplating zone 2 by means of the large support roller 12 and the large front support roller 18 adjacent the entrance to the electroplating zone 2.

The contrarotation of the two large rollers 12, 18 adjacent the entrance to the electroplating zone 2, together with optional similiar controtation of the large support roller 13, and the large front support roller 19 adjacent the exit of the electroplating zone 2 will also serve to move the two support belts 15, 16 and the front support belt 21 through the electroplating zone 2 along with the mated mask 7 and substrate 1, thus allowing the two support belts 15, 16 and the front support belt 21 to grip the mated mask and substrate therebetween to ensure that the mask 7 and substrate 1 are adequately mated.

As the substrate 1 passes the pin wheel 6 and the clamping roller 11, the clamping roller 11 forces the substrate 1 against the mask 7, wound round the pin wheel 6, so as to mate the location features 9 of the mask 7 with the location apertures 22 of the substrate 1. Furthermore the pin wheel 6, having spokes 36 inserted through the pin holes 10 of the mask 7 by virtue of the rotation of the pin wheel 6, then has the spokes 36 of the pin wheel 6 forced through the pin holes 23 of the elongate substrate 1 by the clamping action of the clamping roller 11 forcing the elongate substrate towards the pin wheel 6. In this way the mask 7 and the elongate substrate 1 are continuously mated as the mask 7 and substrate 1 are fed towards the electroplating zone 2, by means of the clamping roller 11 and the pin wheel 6.

The mated mask 7 and elongate substrate 1 are fed through the electroplating zone 2 at a speed such as to allow electro-deposition upon those areas of elongate substrate 1 which are covered by the plating cavities 8 of the mask 7. When the mated mask 7 and substrate 1 emerges from the electroplating zone, the substrate 1 having been electroplated on given areas defined by those areas covered by the plating cavities 8 of the mask 7, the rotation of the front support belt 21 around the large support roller 19 adjacent the exit of the electroplating zone 2, and of the two support belts 15, 16 around the large front support roller 13 adjacent the exit of the electroplating zone 2 releases the pressure of the support belts 15, 16, 21 upon the mated mask 7 and substrate 1. The loosely mated mask 7 and substrate 1 then pass to the front mask roller 5 and the movement of the mask 7 around mask roller 5, returning that section of the endless belt mask 7 to the pin wheel 6, serves to release the mask 7 from the substrate 1 thus allowing the plated substrate 1 to be drawn off for use.

FIG. 2 shows a cross-section of the electroplating zone 2 of the apparatus shown in FIG. 1. The electroplating zone 2 comprises a back wall 24 and a front chamber 25, the front wall 26 of which has an aperture 27 which is aligned with the gap 17 formed between the two support belts 15 and 16. Two grooves 28, 29 are provided on the side of the front wall 26 adjacent the support belts 15, 16. The groove 28, formed in the front wall 26 above the aperture 27, has a width corresponding to the width of the upper support belt 15 and the groove 29, formed in the front wall 26 below the aperture 27, has a width corresponding to the width of the lower support belt 16. In this way the support belts 15 and 16 are retained within the grooves 28, 29 respectively to ensure that the support belts 15 and 16 do not slip and cover the aperture 27 when the support belts 15 and 16 are passing through the electroplating zone 2. It should be realised that the grooves 28, 29 are optional and that their width need not exactly correspond to the width of the respective support belts 15, 16 passing therethrough, so that the grooves 28, 29 allow relative adjustments of the support belts 15 and 16 so as to adjust the width of the gap 17 therebetween, in order to vary the plating thickness provided upon the substrate 1.

The nozzle 30 of a jet plating apparatus extends through the aperture 27, which nozzle is connected to, and contiguous with, a pressure chamber 31 located within the chamber 25. This pressure chamber 31 is sealed from the remainder of the chamber 25 and may be loaded with electrolyte from outside the chamber 25.

The chamber 25 also comprises a second aperture 32 through which electrolyte contained within the chamber 25 may be removed.

Electrolyte is introduced into the pressure chamber 31 and from there is forced out of the jet plating nozzle 30 through aperture 27 and so into a cavity formed by the gap 17 between the support belts 15 and 16. The support belts 15, 16 are preferably made of rubber so that they form a seal against the front wall 26 of the chamber 25 and, on the opposite side of the belts 15, 16 against the mask 7 and the front support belt 21. Thus the gap 17 between the support belts 15 and 16 forms a sealed outer plating cavity.

The electrolyte is forced from the pressure chamber 31 and through the jet plating nozzle 30 by connecting the metal jet plating nozzle 30 (which metal is insoluble in the electrolyte) to the positive terminal of a D.C. supply. The elongate substrate 1, which is similarly made of metal, is connected to the negative terminal of the same D.C. supply. Thus, the electrolyte is accelerated through the jet plating nozzle 30 by means of the charge on the nozzle 30 and is attracted to the charged areas of the elongate substrate 1, which are exposed by the non-conducting mask 7 by virtue of the plating cavities 8.

Because the mask 7 is thin, in this case 0.127 mm thick, the walls of the plating cavities 8 of the mask 7 do not constrain the flow of electrolyte over the areas of the substrate 1 to be plated and thus allow even plating to be effected on those areas which are exposed by the plating cavities 8. Furthermore, because of the thinness of the mask 7 the walls of the plating cavities 8 exhibit a minimum shielding effect to the electric current field created by the oppositely charged plating nozzle 30 and the substrate 1. Thus, by virtue of these two advantages, a more even distribution of plating over the areas of the elongate substrate 1 to be plated is achieved and thus overplating of these areas is not necessary.

The jet plating apparatus 30 is arranged so that the flow of the electrolyte at the surface of the substrate 1 is sufficiently high, for instance in excess of 2 meters per minute, to allow for the high speed electro-deposition required to allow constant feeding of the mated mask 7 and substrate 1 past the jet plating nozzle 30. The flow of electrolyte, shown by arrows 33 in FIG. 2, is from the pressure chamber 31 to the gap 17, formed between the support belts 15, 16, and the force of further electrolyte flowing from the plating nozzle 30 forces electrolyte already in the gap 17 past the jet plating nozzle 30, through the aperture 27, and into the chamber 25, from where the electrolyte maybe removed through the second aperture 32.

An alternative arrangement is envisaged for the electroplating zone 2 wherein the plating area may comprise a labyrinth into which a plating electrolyte is pumped through a supply port, through a patternised metal mesh anode, along the gap 17 between the support belts 15 and 16, before discharging through the mesh anode at an exit port at the opposite end of the electroplating zone 2 from the supply port.

FIG. 3 shows a partially cut away perspective view of the mask 7, substrate 1, support belts 15, 16 and front support belt 21 passing through the electroplating zone 2, shown in cross-section in FIG. 2. FIG. 3 shows two jet plating nozzles 30 positioned adjacent the gap 17 between the two support belts 15, 16.

The mask 7 is mated with the substrate 1 by virtue of the location features 9, in this case dimples pressed into the mask 7, being mated with location apertures 22 on the substrate 1. The pin holes 10 of the mask 7 are aligned with the pin holes 23 of the substrate 1.

The mated substrate 1 and mask 7 are held between the front support belt 21 and the two support belts 15, 16 with the plating cavities 8 of the mask 7 located behind the gap 17 between the two supporting belts 15, 16.

The mated mask 7 and substrate 1, the front support belt 21 and the two support belts 15, 16 are fed through the electroplating zone 2 along the direction shown by arrow 22. Electrolyte is forced through the jet plating nozzles 30, along the direction shown by arrows 33, into the gap 17 between the two support belts 15, 16. The substrate 1 is plated by the electrolyte at those areas exposed by the plating cavities 8 of the mask 7 and, as can be seen from FIG. 3, only those areas 34 exposed by the plating cavities 8 are plated.

The advantages of the thin plastic mask according to the present invention can thus be seen. The small size of the plating cavities within such a mask prevent interference with electrolyte flow and reducing the shielding effect of the walls of the cavities to the electric current field. In this way smaller areas may be plated with improved distribution of the thickness of the plating material, so giving a double saving in the material used in plating, which material is often a precious metal such as platinum or gold.

The plastic nature of the thin mask of the present invention enables the mask to be deformed to compensate for variations in pitch of component areas to be plated in an elongate substrate. This again allows the plating cavities to be made smaller than is currently possible and so enables smaller amounts of plating material to be used. In this respect it should be noted that, although it is preferable to have a resiliently deformfable mask, masks which are deformable without being resiliently deformable may be used as a strip, which strip is coiled around a roller at the entrance to the electroplating zone, is mated with a substrate as it is pulled through the electroplating zone and then the used mask is coiled on a second roller at the exit of the electroplating zone. Such a mask may not, of course, be re-used.

The location features, allowing the mask to be located with the elongate substrate, enable greater accuracy of registration of the plating cavities with the area to be plated. This further increases the ability of the mask to be provided with plating cavities which are small and which correspond almost exactly with the area which is required to be plated.

The mask is also advantageous in that such a mask may be relatively cheaply produced, for instance by producing the mask in quantity as a continuous stamped strip, finite lengths which may be out and joined to form the endless belts used in the apparatus according to the second aspect of the present invention. Worn, damaged or stretched masks may be replaced easily and at small cost. Furthermore such a mask may employ multiple rows of different plating cavities allowing multiple rows of area of the substrate to be plated simultaneously.

The apparatus of the present invention further provides the advantage that the system is simple and it is easy to replace worn or damaged parts.

Furthermore when two support belts, having a gap therebetween, which gap forms a sealed outer plating cavity with the electroplating zone, are used, the gap may then be adjusted to correspondingly adjust the distribution of the plating material on a area to be plated. Furthermore, the apparatus of the present invention may be used for various elongate substrate, in each case only requiring a new mask to be used.

We claim:

1. A thin plastic elongate mask for use in continuously electroplating an elongate substrate comprising location features including dimples, moulded inserts of plastic, stamped-in metal studs, pins or rivets, or apertures all adapted to engage with corresponding features on an elongate substrate to be plated, said location features further including pin holes spaced at regular intervals, such that each adjacent pin hole is engageable with an adjacent spoke of a pin wheel.

2. A mask according to claim 1 wherein the thickness of the mask is no greater than 1 mm.

3. A mask according to claim 1 wherein the thickness of the mask is no less 0.0125 mm.

4. A mask according to claim 1, wherein the thickness of the mask is between 0.125 mm and 0.5 mm.

5. A mask according to claim 4 wherein the mask is 0.127 mm thick.

6. A mask according to claim 1 comprising a plastics material.

7. A mask according to claim 6 wherein the plastic material is polyester, polycarbonate, polyacetate, Kaptan, polyimide or epoxide.

8. An apparatus for continuously electroplating an elongate substrate, the apparatus comprising an electroplating zone, at least one plastic elongate mask, mating means for releasably mating the mask with an elongate substrate, feeding means for feeding the mated mask and substrate through the electroplating zone so that, in use, only given areas of the substrate are plated, and a pin wheel having spokes extending radially therefrom, the mask comprising pin holes spaced along the mask so that, in use, adjacent pin holes of the mask are engageable with adjacent spokes of the pin wheel, and the spoke of the pin wheel being engageable with corresponding pin holes in an elongate substrate, said mating means comprising complementary location features positioned on the substrate and mask, respectively, said location features comprising corresponding projections and recesses, the projections being located on one of a substrate and the mask and the recesses being located on the other of the substrate and the mask.

9. An apparatus according to claim 8 wherein the thickness of the mask is no greater than 1 mm.

10. An apparatus according to claim 8 wherein the apparatus further comprises at least one support belt, which support belt, in use, supports a mated mask and substrate within the electroplating zone.

11. An apparatus according to claim 10 wherein the support belt is an endless belt, moveable in the same direction and the same speed, in use, as the mated mask and substrate, in the electroplating zone.

12. An apparatus according to claim 10 wherein the apparatus comprises two support belts which, in use, support the mask and substrate in the electroplating zone and are locatable between the mask and the electroplating zone, one support belt being locatable above the area of the substrate to be plated and one support being locatable below the area to be plated, both support belts, in use, extending longitudinally, with respect to the mated mask and substrate.

13. An apparatus according to claim 12 further comprising a front support belt, locatable, in use, behind a substrate in the electroplating zone.

14. Apparatus according to claim 12 further comprising a second mask, adapted to be mated with an elongate substrate on another side of the elongate substrate from the first mask, and two further support belts, which, in use, support the second mask and substrate and which, in use, are locatable between the second mask and the electroplating zone, one belt locatable above the area to be plated and one belt locatable below the area to be plated, the electroplating zone being adapted to simultaneously plate areas on two sides of the elongate substrate.

15. Apparatus according to claim 12 wherein the gap between two support belts located on a single side of the substrate is adjustable.

16. Apparatus according to claim 10 wherein at least one support belt is 3–10 mm thick.

17. Apparatus according to claim 10 wherein at least one support belt comprises reinforced rubber.

18. Apparatus according to claim 17 wherein the reinforced rubber is a chloroprene, silastomer, or polyurethane.

19. Apparatus according to any one of claim 8 wherein the feeding means comprises rollers.

20. Apparatus according to claim 19, wherein the rollers are operable to feed at least one support belt through the electroplating zone.

21. Apparatus according to claim 8 wherein the feeding means further comprises a pin wheel.

22. Apparatus according to claim 8 wherein the electroplating zone comprises a jet plating apparatus.

23. Apparatus according to claim 8 wherein the mask is an endless band.

24. A method of continuously electroplating an elongate substrate, the method comprising providing a thin plastic elongate mask having location features including dimples, moulded inserts of plastic, stamped-in metal studs, pins or rivets, apertures all adapted to engage with corresponding features on an elongate substrate to be plated, or pin holes spaced at regular intervals such that each adjacent pin hole is engageable with an adjacent spoke of a pin wheel, mating an elongate substrate with the mask so that only given areas of the substrate are exposed by the mask, feeding the mated substrate mask through an electroplating zone so that the given areas are electroplated, and releasing the electroplated substrate from the mask.

* * * * *